US007220353B2

(12) United States Patent
Gardenier

(10) Patent No.: US 7,220,353 B2
(45) Date of Patent: May 22, 2007

(54) SKIMMER WITH ROTATABLE FILTER CARTRIDGE FOR SPAS AND POOLS

(75) Inventor: W. John Gardenier, Wallingford, CT (US)

(73) Assignee: ThermoSpas, Inc., Wallingford, CT (US)

( * ) Notice: Subject to any disclaimer, the term of this patent is extended or adjusted under 35 U.S.C. 154(b) by 49 days.

(21) Appl. No.: 11/098,092

(22) Filed: Apr. 4, 2005

(65) Prior Publication Data

US 2006/0102541 A1 May 18, 2006

Related U.S. Application Data

(63) Continuation-in-part of application No. 10/992,578, filed on Nov. 18, 2004.

(51) Int. Cl.

| | |
|---|---|
| ***B01D 35/02*** | (2006.01) |
| ***B01D 33/06*** | (2006.01) |
| ***B01D 33/37*** | (2006.01) |
| ***E04H 4/12*** | (2006.01) |

(52) U.S. Cl. ..... 210/167.12; 210/167.14; 210/232; 210/416.2; 4/507

(58) Field of Classification Search ..... 210/169, 210/167.1, 167.12, 167.14, 232, 416.1, 416.2; 4/507

See application file for complete search history.

(56) References Cited

U.S. PATENT DOCUMENTS

| | | | | |
|---|---|---|---|---|
| 1,496,517 | A * | 6/1924 | Boehm | 68/181 R |
| 3,241,676 | A * | 3/1966 | Caple et al. | 210/360.2 |
| 3,297,163 | A * | 1/1967 | Landon | 210/331 |
| 3,448,858 | A * | 6/1969 | Mills et al. | 210/354 |
| 3,532,220 | A * | 10/1970 | Lewis | 210/334 |
| 3,939,505 | A | 2/1976 | Gross | |
| 4,637,873 | A | 1/1987 | DeSousa et al. | |
| 5,330,065 | A * | 7/1994 | Bradley | 211/163 |
| 5,419,831 | A * | 5/1995 | Fuerst et al. | 210/151 |
| 5,423,978 | A * | 6/1995 | Snyder et al. | 210/151 |
| RE35,410 | E | 12/1996 | Adcock et al. | |
| 5,642,534 | A | 7/1997 | Sanchez et al. | |
| 5,679,253 | A * | 10/1997 | Fuerst et al. | 210/619 |
| 5,755,961 | A * | 5/1998 | Limcaco | 210/416.2 |
| 5,853,591 | A * | 12/1998 | Snyder et al. | 210/619 |
| 5,868,926 | A * | 2/1999 | Hickok et al. | 210/150 |
| 5,948,245 | A | 9/1999 | Hodak | |
| 5,989,419 | A | 11/1999 | Dudley et al. | |
| 6,453,483 | B1 | 9/2002 | Jacuzzi et al. | |
| 6,592,341 | B1 | 7/2003 | Olney | |
| 6,868,973 | B1 * | 3/2005 | Kamo et al. | 210/403 |
| 7,029,577 | B2 * | 4/2006 | Cummins | 210/169 |

* cited by examiner

*Primary Examiner*—Fred G. Prince
(74) *Attorney, Agent, or Firm*—Gordon & Jacobson, PC

(57) ABSTRACT

A pool/spa skimmer includes a housing, a face plate, and a flexible weir gate. The housing and plate are dimensioned to allow water to flow in a vertical column. The interior of the housing has a curved wall so that when a column of water passes through the open gate and into the housing, a whirlpool effect is realized. A vertical filter cartridge is mounted on a rotational bearing so that it can spin about its axis. The inlet of a pump is coupled to the cartridge via the bearing and is also coupled to a second water inlet via a vacuum operated valve. The outlet of the pump is also coupled to a water jet which is arranged to enhance the whirlpool effect.

16 Claims, 3 Drawing Sheets

SKIMMER WITH ROTATABLE FILTER CARTRIDGE FOR SPAS AND POOLS

This application is a continuation-in-part of Ser. No. 10/992,578, filed Nov. 18, 2004, the complete disclosure of which is incorporated by reference herein.

BACKGROUND OF THE INVENTION

1. Field of the Invention

This invention relates broadly to water filtration. More particularly, this invention relates to a skimmer having a replaceable cartridge filter.

2. State of the Art

Conventional skimmers for pools and spas include a weir which is hinged at the bottom and provided with a float at the top. Behind the weir is a sump in which a filter or a basket is placed. A filter pump is coupled to the sump and draws water from the pool or spa over the weir and into the sump through the filter or basket. The floating weir assures that the pool/spa water is drawn from the surface into the sump. This causes floating waste to be drawn across the surface of the water and into the skimmer.

In skimmers which have baskets rather than filter cartridges, the owner can see waste accumulate in the basket and will know to empty the basket periodically. Skimmers which utilize replaceable filter cartridges are different. A good example of such a skimmer is shown in U.S. Pat. No. 4,637,873 issued Jan. 20, 1987 to DeSousa et al. A cylindrical filter cartridge is disposed vertically in the skimmer housing below the weir. It is difficult or impossible to determine visually whether the filter needs to be replaced. In addition, because of the way the filter cartridge is disposed in the skimmer housing, it is possible that the outer surface will become unevenly, coated with waste, thereby requiring replacement more frequently than if the filter were evenly coated.

The previously incorporated parent application discloses a skimmer which includes a housing, a skimmer face plate coupled to the housing, and a flexible weir gate coupled to the face plate. When the filter pump is activated, the weir gate flexes to allow water to flow both over the top of the face plate and in a vertical column between the face plate and the housing. The interior of the housing has a curved wall so that when a column of water passes the weir gate and is pulled down into the housing, a whirlpool effect is realized. A vertical filter cartridge is mounted on a rotational bearing in the housing so that it can spin about its axis. The inlet of a filter pump is coupled to the cartridge via the bearing. The inlet of the pump is also coupled to a below the surface water inlet via a check valve. When the filter is clean, water is drawn through it by the pump and the filter spins about its axis due to the whirlpool effect of the column of water. When the filter reaches a threshold dirt covering, water is no longer drawn through it and the draw through the housing is decreased, causing the check valve to open to allow more water to the pump. As the flow rate through the housing decreases, the rate of rotation of the cartridge decreases, thus giving a visual indication that it needs to be replaced. Spinning the cartridge during operation also causes it to be more evenly coated with dirt. This makes more efficient use of the cartridge.

SUMMARY OF THE INVENTION

It is therefore an object of the invention to provide a skimmer and filter for a pool or spa.

It is another object of the invention to provide a skimmer which uses replaceable filter cartridges.

It is a further object of the invention to provide a skimmer which provides a visual indication of when a filter cartridge needs to be replaced.

It is also an object of the invention to provide a skimmer which makes more efficient use of filter cartridges.

In accord with these objects, which will be discussed in detail below, the skimmer according to the invention includes a housing, a skimmer face plate coupled to the housing, and a flexible weir gate coupled to the face plate. When the filter pump is activated, the weir gate flexes to allow water to flow both over the top of the face plate and in a vertical column between the face plate and the housing. The interior of the housing has a curved wall so that when a column of water passes the weir gate and is pulled down into the housing, a whirlpool effect is realized. A vertical filter cartridge is mounted on a rotational bearing in the housing so that it can spin about its axis. The inlet of a filter pump is coupled to the cartridge via the bearing. The inlet of the pump is also coupled to a below the surface water inlet via a check valve. When the filter is clean, water is drawn through it by the pump and the filter spins about its axis due to the whirlpool effect of the column of water. When the filter reaches a threshold dirt covering, water is no longer drawn through it and the draw through the housing is decreased, causing the check valve to open to allow more water to the pump. As the flow rate through the housing decreases, the rate of rotation of the cartridge decreases, thus giving a visual indication that it needs to be replaced. Spinning the cartridge during operation also causes it to be more evenly coated with dirt. This makes more efficient use of the cartridge.

According to an illustrated embodiment, the weir gate flexes about a central mount and two filter cartridges are arranged side by side. When clean, the filter cartridges spin in opposite directions.

According to the present invention, at least one water jet is arranged between the weir gate and the cartridge. The jet is arranged to spray water at the cartridge to assist in the spinning of the cartridge. According to a preferred embodiment, the jet is coupled to water under pressure via a valve which closes when the cartridge is dirty.

Additional objects and advantages of the invention will become apparent to those skilled in the art upon reference to the detailed description taken in conjunction with the provided figures.

BRIEF DESCRIPTION OF THE DRAWINGS

FIG. 3 is a schematic top view of a skimmer assembly according to the invention with the pump on; and FIG. 4 is a schematic side elevation view of the skimmer assembly with the pump on.

DETAILED DESCRIPTION OF THE PREFERRED EMBODIMENTS

Figure 1:
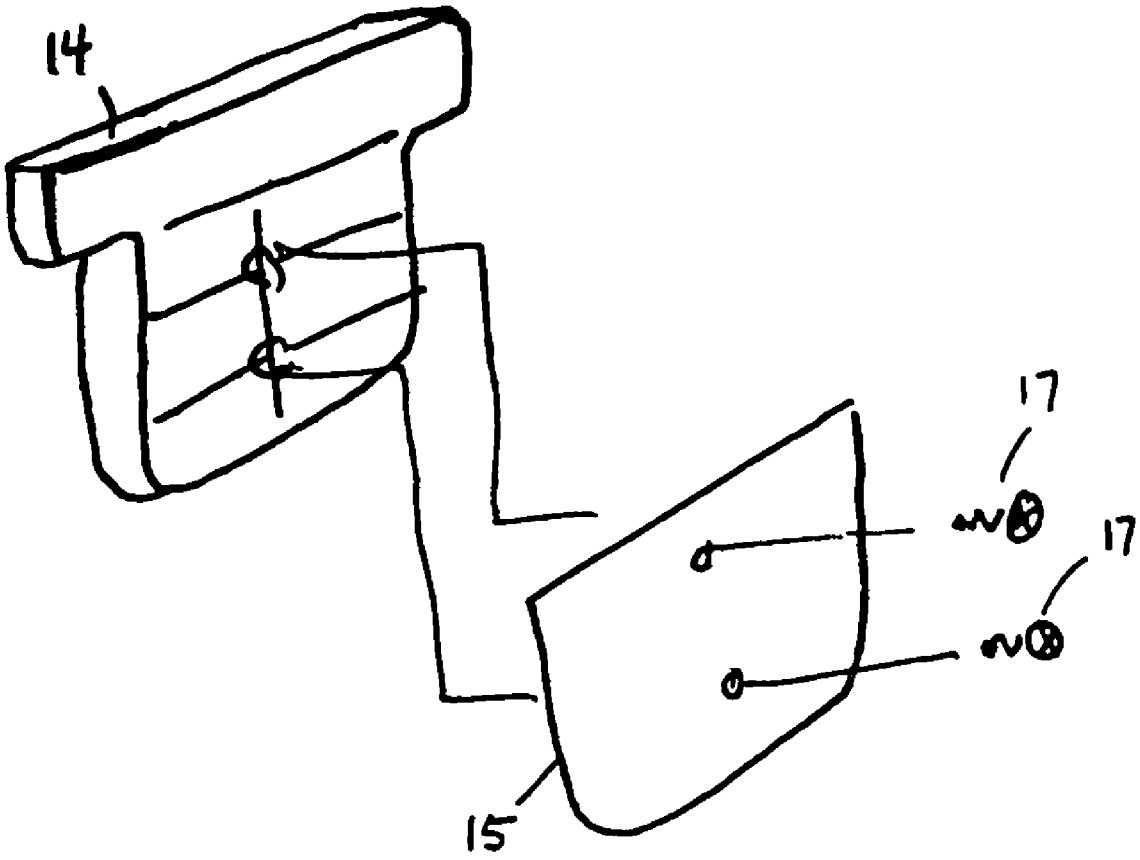
FIG. 1 is an exploded perspective view of a portion of a skimmer assembly according to the invention.

Referring now to FIGS. 1-4, a skimmer 10 according to the invention includes a first housing 12 and a skimmer face plate 14 opening into the housing. The face plate 14 is dimensioned to form lateral vertical gaps 16, 18 which allow water W to flow in vertical columns between the face plate 14 and the first housing 12, and a top gap 19 over which water W can flow. This is illustrated best in FIGS. 3 and 4. In addition, and as shown in FIGS. 1-4, the face plate 14 has a flexible weir gate 15 coupled to it by fasteners 17 which are centrally located to allow the edges of the gate 15 to flex. When water passes through the gaps 16, 18, 19 between the weir gate 14 and the first housing 12, the sides and top of the weir gate 15 flex. Flexion at the top allows water to be skimmed across the surface. Flexion at the sides allows water to enter the housing 12 in columns. When the pump is deactivated, the weir gate 15 reassumes its original shape and covers the gaps 16, 18, 19.

Figure 2:
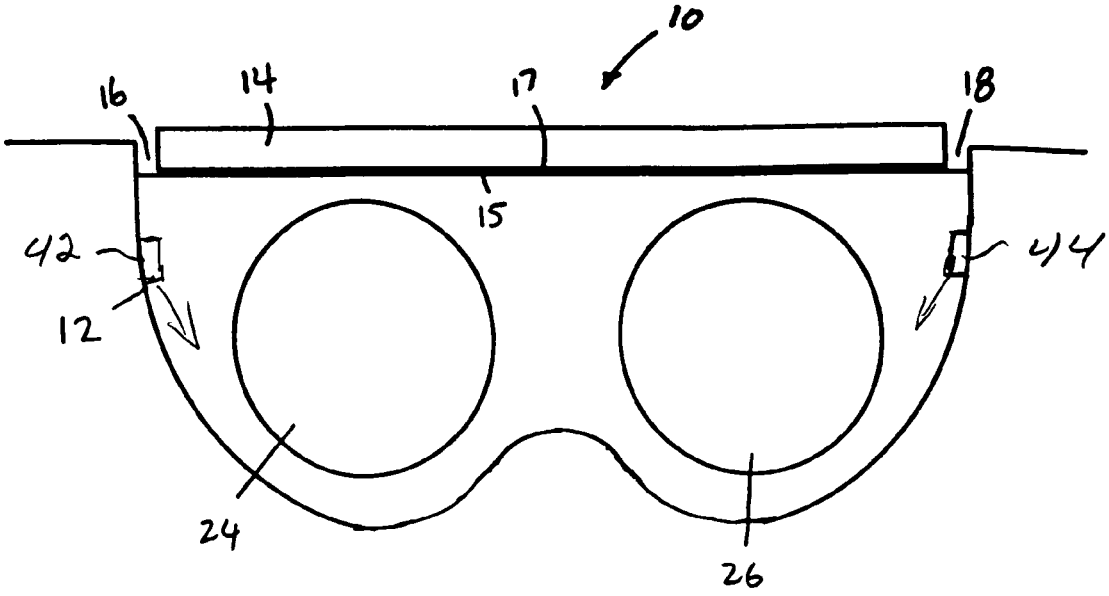
FIG. 2 is a schematic top view of a skimmer assembly according to the invention with the pump off.
Figure 3:
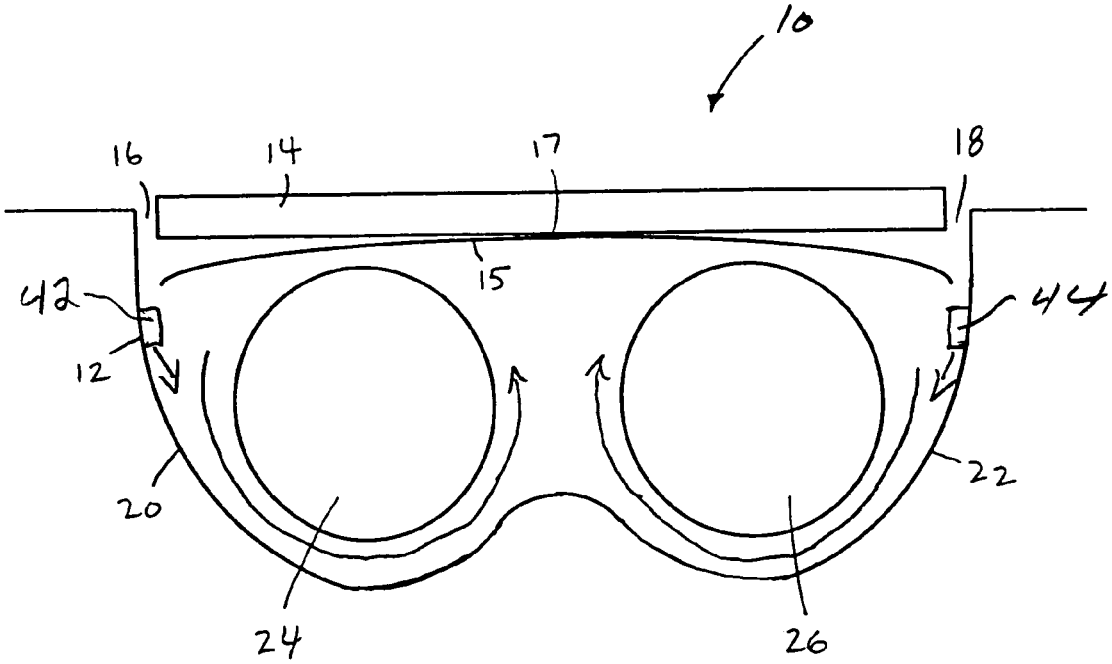
Figure 4:
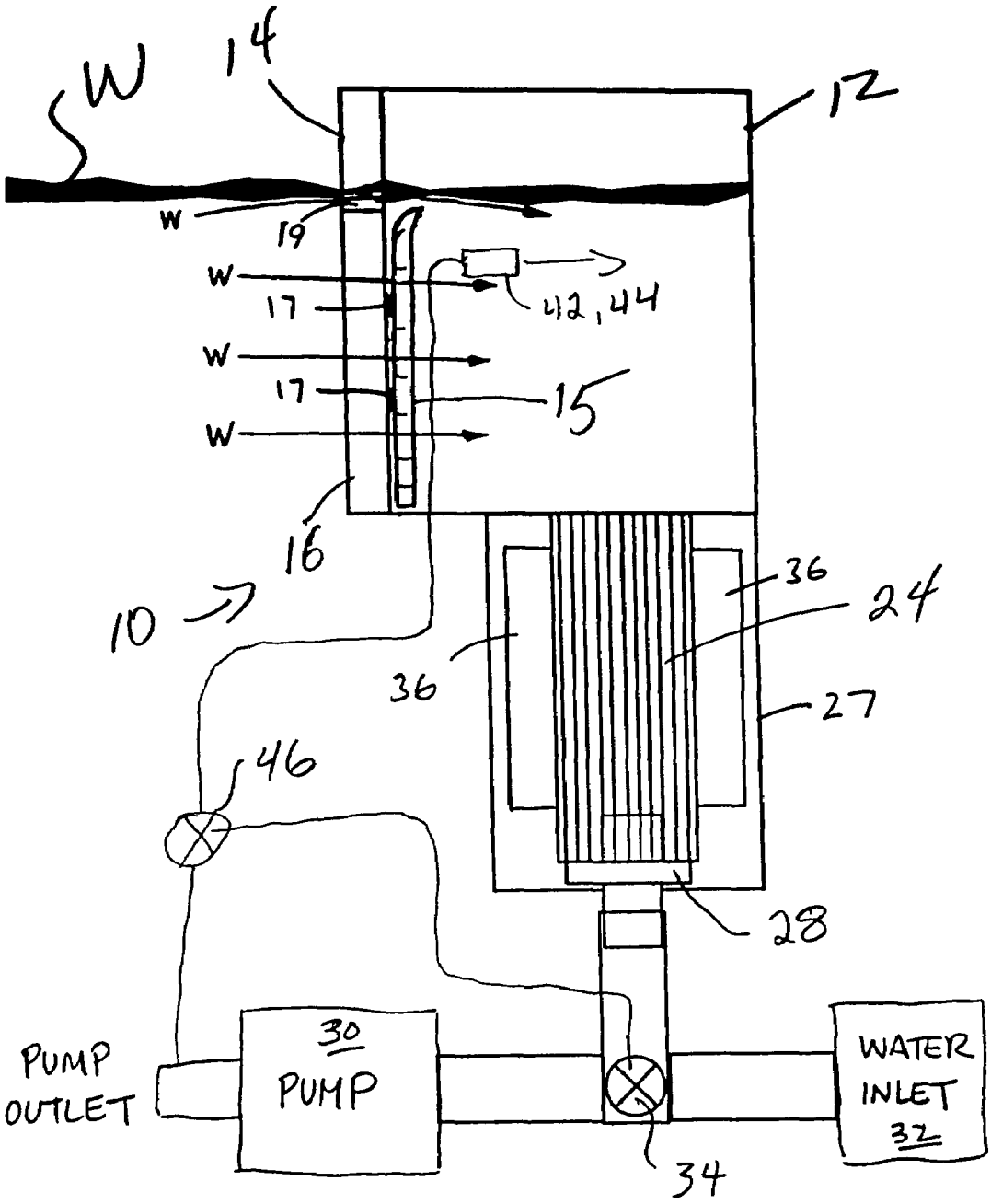

As seen best in FIGS. 2 and 3, the interior of the first housing 12 has a pair of curved walls 20, 22 each adjacent one of the gaps 16, 18. The curved walls are arranged so that when a column of water passes through the gaps 16, 18 between the face plate 14 and the first housing 12, and over the weir gate 15, a whirlpool effect is realized. This is illustrated by the circular arrows in FIG. 3. A pair of vertical filter cartridges 24, 26 are mounted beneath the face plate in a second housing 27 (shaped similar to the first housing 12) as shown in FIGS. 2-4. Each cartridge is mounted on a rotational bearing, one of which 28 is shown in relation to cartridge 24 in FIG. 4. The rotational bearings allow the filter cartridges to spin under the influence of the whirlpools as shown by the arrows in FIG. 3. Optionally, the filter cartridges may be provided with radially extending longitudinal fins 36 to aid in spinning the cartridge under the influence of the whirlpool. Although the drawing shows only two fins, three or four are preferred. Other rotational aids may also be provided to the filter cartridges, such as paddle wheel elements at one or both ends of the cartridges.

According to the present invention, at least one water jet and preferably two 42, 44 are arranged between the weir gate 15 and the cartridges 24, 26. The jets are arranged to spray water at the cartridges to assist in the spinning of the cartridge.

The inlet of a filter pump 30 is coupled to the cartridge 24 via the bearing 28 as shown in FIG. 4. The inlet of the pump is also coupled to a water inlet 32 via a check valve 34. The water inlet 32 is located below the surface of the water W. It will be appreciated that the outlet of the pump 30 returns filtered water back to the pool/spa. When the filter cartridges 24, 26 are clean, water is drawn through them by the pump 30 and the cartridges spin about their axes due to the whirlpool effect of the column of water. When a cartridge reaches a threshold dirt covering, water is no longer drawn through it and the check valve 34 opens to allow more water the pump 30. The check valve 34 may be coupled to a shut off valve 46 which shuts off water to the jets 42, 44 when the check valve 34 opens. When water is no longer being drawn through the filter cartridges and water is no longer being sprayed by the jets 42, 44, the cartridges stop spinning, thus giving a visual indication that the cartridges need to be replaced. Spinning the cartridges during operation also causes them to be more evenly coated with dirt. This makes more efficient use of the cartridge.

Alternative to providing the valve 46, the weir gate 15 and the jets 42, 44 may be arranged so that neither supplies enough water pressure to spin the cartridges, i.e. that that cartridges only spin when they are clean and the jets are spraying.

In yet another alternative embodiment, the jets 42, 44 are operated with sufficient pressure to rotate the cartridges regardless of the amount of dirt loaded onto the cartridges.

There have been described and illustrated herein several embodiments of a pool/spa skimmer. While particular embodiments of the invention have been described, it is not intended that the invention be limited thereto, as it is intended that the invention be as broad in scope as the art will allow and that the specification be read likewise. Thus, while the illustrated skimmer has two filter cartridges, it will be appreciated that a skimmer with a single cartridge and at least one jet could be constructed incorporating the features of the invention. In a single filter embodiment, the face plate would be configured to allow only a single column of water to enter the housing. Instead of a flexible weir gate, a spring biased hinged gate could be used. It will therefore be appreciated by those skilled in the art that yet other modifications could be made to the provided invention without deviating from its spirit and scope as claimed.

What is claimed is:

1. A pool/spa skimmer for use with a removable filter cartridge, comprising:
- a housing;
- a rotational bearing mounted in said housing and adapted to receive the filter cartridge; and
- means for creating a whirlpool in said housing such that when the filter cartridge is installed, the filter cartridge rotates on said rotational bearing, wherein
- said means for creating a whirlpool includes a water jet, said means for creating a whirlpool includes a skimmer face plate arranged to form a gap with said housing, said gap below water level such that water enters said housing in a column.

2. A pool/spa skimmer according to claim 1, wherein:
- said means for creating a whirlpool includes a curved wall in said housing adjacent to said gap.

3. A pool/spa skimmer according to claim 1, further comprising:
- neither said skimmer face plate nor said water jet alone causes the whirlpool.

4. A pool/spa skimmer according to claim 1, further comprising:
- a shut off valve coupled to said water jet, automatically shutting off said water jet when the filter cartridge is dirty.

5. A pool/spa skimmer according to claim 1, further comprising:
- a removable filter cartridge mounted on said rotational bearing.

6. A pool/spa skimmer according to claim 5, wherein:
- said filter cartridge includes rotational means for aiding rotation of said cartridge under the influence of the whirlpool.

7. A pool/spa skimmer according to claim 5, wherein:
- said rotational means includes a plurality of substantially radial fins.

8. A pool/spa skimmer for use with a pair of removable filter cartridges, comprising:
- a housing;
- a pair of spaced apart rotational bearings mounted in said housing and adapted to receive the filter cartridges; and
- means for creating two whirlpools in said housing such that, when installed, each of the removable filter cartridges rotates on its respective rotational bearing, wherein
- said means for creating includes two water jets.

9. A pool/spa skimmer according to claim 8, wherein:
- said means for creating two whirlpool includes an element arranged to form a pair of gaps with said housing such that water enters said housing in two spaced apart columns.

10. A pool/spa skimmer according to claim 9, wherein:
neither said water jets nor said element alone create the whirlpool.

11. A pool/spa skimmer according to claim 8, wherein:
said means for creating two whirlpools includes two curved walls in said housing, each adjacent to a respective gap.

12. A pool/spa skimmer according to claim 8, further comprising:
a shut off valve coupled to said jets automatically shutting off said jets when the filter cartridges are dirty.

13. A pool/spa skimmer according to claim 8, further comprising:
a pair of removable filter cartridges mounted on said rotational bearings.

14. A pool/spa skimmer according to claim 13, wherein:
each of filter cartridges includes rotational means for aiding rotation of said cartridge under the influence of respective whirlpools.

15. A pool/spa skimmer according to claim 14, wherein:
said rotational means includes a plurality of substantially radial fins.

16. A pool/spa skimmer comprising:
a rotatable bearing;
a filter cartridge mounted on said rotatable bearing below a water level of the pool/spa;
a water jet directed at said filter cartridge;
a shut off valve coupled to said water jet;
a check valve; and
a pump having an inlet and an outlet, said inlet coupled to said filter cartridge and a water inlet from the spa/pool via said check valve, and said outlet being coupled to the pool/spa and to the water jet via the shut off valve,
wherein when said filter cartridge is clean, said pump draws water from the pool/spa through said filter cartridge and pumps water through said water jet in a manner which causes said filter cartridge to rotate on said bearing, and when said filter cartridge is sufficiently loaded with dirt, said check valve is activated to cause said pump to draw water from the pool/spa through said check valve and said water inlet from the pool spa and to activate said shut off valve so as to slow or to stop rotation of said filter cartridge on said bearing.

* * * * *